US011241128B2

(12) United States Patent
Vish

(10) Patent No.: US 11,241,128 B2
(45) Date of Patent: Feb. 8, 2022

(54) TOILET ASSEMBLY

(71) Applicant: Sloan Valve Company, Franklin Park, IL (US)

(72) Inventor: Ronald J. Vish, West Roxbury, MA (US)

(73) Assignee: Sloan Valve Company, Franklin Park, IL (US)

( * ) Notice: Subject to any disclaimer, the term of this patent is extended or adjusted under 35 U.S.C. 154(b) by 23 days.

(21) Appl. No.: 16/716,036

(22) Filed: Dec. 16, 2019

(65) Prior Publication Data

US 2020/0187732 A1 Jun. 18, 2020

Related U.S. Application Data

(60) Provisional application No. 62/779,890, filed on Dec. 14, 2018.

(51) Int. Cl.
*A47K 13/26* (2006.01)
*A47K 13/12* (2006.01)

(52) U.S. Cl.
CPC ..... *A47K 13/26* (2013.01); *A47K 13/12* (2013.01)

(58) Field of Classification Search
CPC ..... A47K 13/12; A47K 13/26
USPC ..... 4/420, 240
See application file for complete search history.

(56) References Cited

U.S. PATENT DOCUMENTS

| | | | | |
|---|---|---|---|---|
| 2,153,536 | A * | 4/1939 | Groeniger | A47K 13/12 4/422 |
| 5,884,342 | A * | 3/1999 | Maake | A47K 13/12 4/236 |
| 6,012,180 | A | 1/2000 | Williams | |
| 2005/0172384 | A1* | 8/2005 | Hayashi | A47K 13/12 4/246.1 |
| 2008/0313796 | A1* | 12/2008 | Wendt | A47K 13/12 4/234 |
| 2017/0362808 | A1 | 12/2017 | Snyder et al. | |

OTHER PUBLICATIONS

Jun. 26, 2020—(WO) ISR and WO—App PCT/US20/066617.
Aug. 16, 2021—(IN) First Examination Report—App 202147026775.

* cited by examiner

*Primary Examiner* — Christine J Skubinna
(74) *Attorney, Agent, or Firm* — Banner & Witcoff, Ltd.

(57) ABSTRACT

A toilet assembly includes a toilet with a bowl, a rim surrounding the bowl, and a water inlet pipe extending upward from a rear of the toilet, a toilet seat that rests on the rim and has an opening positioned above the bowl, and an attachment connected to the inlet pipe and the toilet seat. The attachment may include a coupling engaging the inlet pipe and a hinge connection connected to the coupling, where the seat is pivotably connected to the hinge connection of the attachment to pivotably mount the seat on the toilet, such that the seat is pivotable about the hinge connection between a raised position and a lowered position. The coupling may engage the inlet pipe such that the hinge connection is positioned and connected to the seat at a location spaced upward from the top surface of the rear of the toilet.

20 Claims, 13 Drawing Sheets

TOILET ASSEMBLY

CROSS-REFERENCE TO RELATED APPLICATION

This application is a non-provisional of, and claims priority to, U.S. Provisional Application No. 62/779,890, filed Dec. 14, 2018, which prior application is incorporated by reference herein in its entirety.

FIELD OF THE INVENTION

This disclosure relates to toilets and toilet seats, and more specifically to structures for toilet seats and attachments for mounting toilet seats on a toilet.

BACKGROUND

Toilets in typical use involve many sanitary concerns and must be cleaned frequently to avoid buildup of unsanitary material and an unsanitary visual impression. The hinge connections that connect a toilet seat to a typical toilet are positioned close to the bowl and have multiple surfaces and small spaces that can be difficult to clean, including spaces between moving components. Additionally, the positioning of these hinges and the close proximity of the rear of the toilet seat to the top surface of the toilet increase the difficulty of fully cleaning beneath the rear of the seat and around the hinge connections. Further, the act of raising a toilet seat can be difficult to perform without creating potentially unsanitary conditions. A user may place their hand underneath the toilet seat, but the close proximity of the underside of the seat to the rim of the toilet often results in contact between the user's hand and the toilet rim. Alternately, a user may attempt to use their foot to raise the seat, but typical toilet seats do not provide surfaces that may easily and reliably be engaged by a user's foot for this purpose.

The present disclosure is provided to address this need and other needs in existing toilets and components thereof. A full discussion of the features and advantages of the present invention is deferred to the following detailed description, which proceeds with reference to the accompanying drawings.

BRIEF SUMMARY

General aspects of the present disclosure relate to a toilet assembly that includes a toilet having a toilet body with a bowl, a rim surrounding the bowl, and a water inlet pipe extending upward from a rear of the toilet, where the water inlet pipe is configured to be connected to a water supply to supply water to the bowl, a toilet seat configured to rest on the rim and having an opening positioned above the bowl, and an attachment connected to the water inlet pipe and the toilet seat. The attachment may include a coupling engaging the water inlet pipe and a hinge connection connected to the coupling, where the toilet seat is pivotably connected to the hinge connection of the attachment to pivotably mount the toilet seat on the toilet, such that the toilet seat is pivotable about the hinge connection between a raised position, where the toilet seat is raised above the rim of the toilet, and a lowered position, where the toilet seat rests on the rim of the toilet. The coupling may engage the water inlet pipe such that the hinge connection is positioned and connected to the seat at a location spaced upward from the top surface of the rear of the toilet. General aspects of the present disclosure relate to a toilet seat or toilet seat assembly configured for this installation.

Aspects of the disclosure relate to a toilet assembly that includes a toilet having a toilet body with a bowl at a front of the toilet and a rim surrounding the bowl, and a water inlet pipe extending upward from a rear of the toilet, behind the bowl, wherein the water inlet pipe is configured to be connected to a water supply to supply water to the bowl, a toilet seat having a resting portion configured to rest on the rim and having an opening positioned above the bowl, and an attachment connected to the water inlet pipe and the toilet seat. The attachment includes a coupling having a passage that receives the water inlet pipe therethrough, such that the coupling engages the water inlet pipe, and a hinge connection connected to the coupling. The toilet seat is pivotably connected to the hinge connection of the attachment to pivotably mount the toilet seat on the toilet, such that the toilet seat is pivotable about the hinge connection between a raised position, where the resting portion of the toilet seat is raised above the rim of the toilet, and a lowered position, where the resting portion of the toilet seat rests on the rim of the toilet.

According to one aspect, the toilet assembly further includes a flush valve connected to the water inlet pipe above the toilet body and configured to control a flow of water through the water inlet pipe into the bowl.

According to another aspect, the toilet seat includes a first side portion extending around a first side of the opening and a second side portion extending around a second side of the opening opposite the first side, and the resting portion includes a first seat pad on an underside of the toilet seat on the first side portion, and a second seat pad on the underside of the toilet seat on the second side portion, the first and second seat pads configured to rest on the rim of the toilet. In one configuration, the first and second side portions are joined at a rear of the toilet seat and distal ends of the first and second side portions are spaced from each other at a front of the toilet seat, and the first seat pad extends downward from the underside of the toilet seat on the first side portion, and the second seat pad extends downward from the underside of the toilet seat on the second side portion. In this configuration, the resting portion further includes a third seat pad on the first side portion configured to rest on the rim of the toilet, where the distal end of the first side portion curves downward to form the third seat pad, and the underside of the toilet seat on the first side portion is raised to form a first slot between the first and third seat pads, and a fourth seat pad on the second side portion configured to rest on the rim of the toilet, where the distal end of the second side portion curves downward to form the fourth seat pad, and the underside of the toilet seat on the second side portion is raised to form a second slot between the second and fourth seat pads.

According to a further aspect, the water inlet pipe extends through a top surface of the rear of the toilet, and the coupling is positioned such that the hinge connection is positioned at a location spaced upward from the top surface of the rear of the toilet. In one configuration, the attachment further includes a base connected to the coupling and extending below the coupling to rest on the top surface of the rear of the toilet to space the coupling and the hinge connection above the top surface. In another configuration, the coupling fixedly engages the water inlet pipe such that a lowermost point of the attachment is spaced upward from the top surface of the rear of the toilet. In a further configuration, the toilet seat has a lower portion having the resting portion thereon and a raised rear portion extending upwardly from the lower portion, and the raised rear portion of the toilet seat is pivotably connected to the hinge connection of the attachment to pivotably mount the toilet seat on the toilet, such that the raised rear portion of the toilet seat extends upward from the lower portion of the toilet seat and upward above the top surface of the rear of the toilet to connect to the hinge connection.

According to yet another aspect, the coupling may have a friction-increasing structure and/or a mechanical engaging structure engaging the water inlet pipe to resist slippage between the water inlet pipe and the attachment.

According to a still further aspect, a top surface of the toilet body has an opening receiving the water inlet pipe and has an uninterrupted surface that surrounds the opening and extends from the opening to the rim across an entire width of the top surface.

Additional aspects of the disclosure relate to a toilet seat assembly that includes a toilet seat having an opening configured to be positioned above a bowl of a toilet and having a first side portion extending around a first side of the opening, a second side portion extending around a second side of the opening opposite the first side, a first seat pad on an underside of the toilet seat on the first side portion, and a second seat pad on the underside of the toilet seat on the second side portion, where the first and second seat pads are configured to rest on a rim of the toilet, and an attachment connected to the toilet seat and configured to be connected to a water inlet pipe of the toilet. The attachment includes a coupling having a passage that is configured to receive the water inlet pipe therethrough, such that the coupling is configured to engage the water inlet pipe, and a hinge connection connected to the coupling. The toilet seat is pivotably connected to the hinge connection of the attachment, such that the attachment is configured for pivotably mounting the toilet seat on the toilet, and the toilet seat is pivotable about the hinge connection between a raised position, where the first and second seat pads of the toilet seat are configured to be raised above the rim of the toilet, and a lowered position, where the first and second seat pads of the toilet seat are configured to rest on the rim of the toilet.

According to one aspect, the first side portion and the second side portion are joined at a rear of the toilet seat and are spaced at a front of the toilet seat. In one configuration, the first seat pad extends downward from the underside of the toilet seat on the first side portion, and the second seat pad extends downward from the underside of the toilet seat on the second side portion, and the toilet seat further includes third and fourth seat pads on the third and fourth side portions, configured to rest on the rim of the toilet. The distal end of the first side portion curves downward to form the third seat pad, and the underside of the toilet seat on the first side portion is raised to form a first slot between the first and third seat pads. The distal end of the second side portion curves downward to form the fourth seat pad, and the underside of the toilet seat on the second side portion is raised to form a second slot between the second and fourth seat pads.

According to another aspect, the coupling is positioned such that the hinge connection is positioned at a location spaced upward from a top surface of a rear of the toilet. In one configuration, the attachment further includes a base connected to the coupling and extending below the coupling and configured to rest on the top surface of the rear of the toilet to space the coupling and the hinge connection above the top surface. In another configuration, the coupling is configured to fixedly engage the water inlet pipe such that a lowermost point of the attachment is configured to be spaced upward from the top surface of the rear of the toilet. In a further configuration, the toilet seat has a lower portion having the first and second seat pads thereon and a raised rear portion extending upwardly from the lower portion, and the raised rear portion of the toilet seat is pivotably connected to the hinge connection of the attachment, such that the raised rear portion of the toilet seat extends upward from the lower portion of the toilet seat and is configured to extend upward above the top surface of the rear of the toilet to connect to the hinge connection.

According to a further aspect, the coupling has a friction-increasing structure configured for engaging the water inlet pipe to resist slippage between the water inlet pipe and the attachment.

Further aspects of the disclosure relate to a toilet assembly that includes a toilet comprising a toilet body having a bowl at a front of the toilet and a rim surrounding the bowl, and a water inlet pipe extending upward from a top surface of a rear of the toilet, behind the bowl, where the water inlet pipe is configured to be connected to a water supply to supply water to the bowl, a toilet seat having a resting portion configured to rest on the rim and having an opening positioned above the bowl, and an attachment connected to the water inlet pipe and the toilet seat. The attachment includes a coupling fixedly engaging the water inlet pipe at a location spaced upward from the top surface of the rear of the toilet, such that a lowermost point of the attachment is spaced upward from the top surface of the rear of the toilet, and a hinge connection connected to the coupling. The toilet seat is pivotably connected to the hinge connection of the attachment to pivotably mount the toilet seat on the toilet, such that the toilet seat is pivotable about the hinge connection between a raised position, where the resting portion of the toilet seat is raised above the rim of the toilet, and a lowered position, where the resting portion of the toilet seat rests on the rim of the toilet.

According to one aspect, the toilet assembly also includes a flush valve connected to the water inlet pipe above the toilet body and configured to control a flow of water through the water inlet pipe into the bowl.

According to another aspect, the toilet seat includes a first side portion extending around a first side of the opening and a second side portion extending around a second side of the opening opposite the first side, and the resting portion includes a first seat pad on an underside of the toilet seat on the first side portion and a second seat pad on the underside of the toilet seat on the second side portion, the first and second seat pads configured to rest on the rim of the toilet. In one configuration, the first and second side portions are joined at a rear of the toilet seat and distal ends of the first and second side portions are spaced from each other at a front of the toilet seat, and the first seat pad extends downward from the underside of the toilet seat on the first side portion, and the second seat pad extends downward from the underside of the toilet seat on the second side portion. In this configuration, the resting portion further includes a third seat pad on the first side portion configured to rest on the rim of the toilet, where the distal end of the first side portion curves downward to form the third seat pad, and the underside of the toilet seat on the first side portion is raised to form a first slot between the first and third seat pads, and a fourth seat pad on the second side portion configured to rest on the rim of the toilet, where the distal end of the second side portion curves downward to form the fourth seat pad, and the underside of the toilet seat on the second side portion is raised to form a second slot between the second and fourth seat pads.

According to a further aspect, the toilet seat has a lower portion having the resting portion thereon and a raised rear portion extending upwardly from the lower portion, and the raised rear portion of the toilet seat is pivotably connected to the hinge connection of the attachment to pivotably mount the toilet seat on the toilet, such that the raised rear portion of the toilet seat extends upward from the lower portion of the toilet seat and upward above the top surface of the rear of the toilet to connect to the hinge connection.

According to yet another aspect, the coupling has a friction-increasing structure and/or a mechanical engaging structure configured for engaging the water inlet pipe to resist slippage between the water inlet pipe and the attachment for fixedly engaging the water inlet pipe. These structures may be configured for fixedly engaging the water inlet pipe.

According to a still further aspect, a top surface of the toilet body has an opening receiving the water inlet pipe and has an uninterrupted surface that surrounds the opening and extends from the opening to the rim across an entire width of the top surface.

According to another aspect, the coupling has a passage that receives the water inlet pipe therethrough.

Still further aspects of the disclosure relate to a toilet seat assembly that includes a toilet seat having an opening configured to be positioned above a bowl of a toilet, the toilet seat having a lower portion having a resting portion configured to rest on a rim of the toilet and a raised rear portion extending upwardly from the lower portion, and an attachment connected to the toilet seat and configured to be connected to a water inlet pipe of the toilet. The attachment includes a coupling configured to fixedly engage the water inlet pipe at a location spaced upward from a top surface of a rear of the toilet, such that a lowermost point of the attachment is configured to be spaced upward from the top surface of the rear of the toilet, and a hinge connection connected to the coupling. The raised rear portion of the toilet seat is pivotably connected to the hinge connection of the attachment such that the attachment is configured for pivotably mounting the toilet seat on the toilet, and such that the raised rear portion of the toilet seat extends upward from the lower portion of the toilet seat and is configured to extend upward above the top surface of the rear of the toilet to connect to the hinge connection. The toilet seat is pivotable about the hinge connection between a raised position, where the resting portion of the toilet seat is configured to be raised above the rim of the toilet, and a lowered position, where the resting portion of the toilet seat is configured to rest on the rim of the toilet.

According to one aspect, the toilet seat includes a first side portion extending around a first side of the opening and a second side portion extending around a second side of the opening opposite the first side, and the resting portion includes a first seat pad on an underside of the toilet seat on the first side portion, and a second seat pad on the underside of the toilet seat on the second side portion, the first and second seat pads configured to rest on the rim of the toilet.

According to another aspect, the first and second side portions are joined at a rear of the toilet seat and distal ends of the first and second side portions are spaced from each other at a front of the toilet seat, and the first and second seat pads extend downward from the underside of the toilet seat on the first and second side portions. In this configuration, the resting portion further includes a third seat pad on the first side portion configured to rest on the rim of the toilet, where the distal end of the first side portion curves downward to form the third seat pad, and the underside of the toilet seat on the first side portion is raised to form a first slot between the first and third seat pads, and a fourth seat pad on the second side portion configured to rest on the rim of the toilet, where the distal end of the second side portion curves downward to form the fourth seat pad, and the underside of the toilet seat on the second side portion is raised to form a second slot between the second and fourth seat pads.

According to a further aspect, the coupling has a friction-increasing structure and/or a mechanical engaging structure configured for engaging the water inlet pipe, such that the friction-increasing structure is configured to resist slippage between the water inlet pipe and the attachment for fixedly engaging the water inlet pipe.

According to yet another aspect, the coupling has a passage configured for receiving the water inlet pipe therethrough.

Other aspects of the disclosure relate to a toilet seat that includes a first side portion extending around a first side of an opening configured to be positioned above a bowl of a toilet, a second side portion extending around a second side of the opening opposite the first side, where the first and second side portions are joined at a rear of the toilet seat and distal ends of the first and second side portions are spaced from each other at a front of the toilet seat, and first, second, third, and fourth seat pads configured to rest on the rim of the toilet. The first seat pad extends downward from an underside of the toilet seat on the first side portion, and the second seat pad extends downward from the underside of the toilet seat on the second side portion. The third seat pad is on the first side portion, and the distal end of the first side portion curves downward to form the third seat pad. The fourth seat pad is on the second side portion, and the distal end of the second side portion curves downward to form the fourth seat pad. The underside of the toilet seat on the first side portion is raised to form a first slot between the first and third seat pads, and the underside of the toilet seat on the second side portion is raised to form a second slot between the second and fourth seat pads.

Other aspects of the disclosure relate to a toilet seat that includes a first side portion extending around a first side of an opening configured to be positioned above a bowl of a toilet, a second side portion extending around a second side of the opening opposite the first side, where the first and second side portions are joined at a rear of the toilet seat and distal ends of the first and second side portions are spaced from each other at a front of the toilet seat, and first and second extendible handles connected to the first and second side portions. Each of the first and second handles is configured to be movable between a retracted position, where the outer periphery of the handle is positioned more proximate to the respective side portion, and an extended position, where the outer periphery of the handle is positioned more distal from the respective side portion and the handle is extended to facilitate manipulation by a user. The handles may be extendible by a pivoting or a sliding movement mechanism in various configurations.

Other aspects of the disclosure relate to a toilet seat that includes a first side portion extending around a first side of an opening configured to be positioned above a bowl of a toilet, and a second side portion extending around a second side of the opening opposite the first side, where the first and second side portions are joined at a rear of the toilet seat and distal ends of the first and second side portions are spaced from each other at a front of the toilet seat. A first seat pad extends downward from an underside of the toilet seat on the first side portion, and a second seat pad extends downward from the underside of the toilet seat on the second side portion, wherein the first and second seat pads are configured to rest on the rim of the toilet. A first handle is connected to the first side portion and extends outward from a periphery of the seat and is configured to extend beyond a periphery of the toilet, the first handle having a first point extending furthest from the periphery of the seat, where the first point is positioned at the distal end of the first side portion, and the distal end of first side portion and the first handle combine to form a first smooth and continuous surface extending from the opening to the first point of the first handle. A second handle is connected to the second side portion and extends outward from the periphery of the seat and is configured to extend beyond the periphery of the toilet, the second handle having a second point extending furthest from the periphery of the seat, where the second point is positioned at the distal end of the second side portion, and the distal end of second side portion and the second handle combine to form a second smooth and continuous surface extending from the opening to the second point of the second handle.

Other aspects of the disclosure relate to a toilet assembly that includes a toilet body having a bowl at a front of the toilet, with a rim surrounding the bowl, and a top surface extending rearward from the rim, the top surface having a hole positioned behind the bowl, and a water inlet pipe extending downward into the hole, where the water inlet pipe is configured to be connected to a water supply to supply water to the bowl. The top surface of the toilet body has an uninterrupted surface that surrounds the hole and extends from the hole to the rim across an entire width of the top surface. In one configuration, the toilet assembly also includes an attachment connected to the water inlet pipe, the attachment having a hinge connection, and a toilet seat pivotably connected to the hinge connection.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
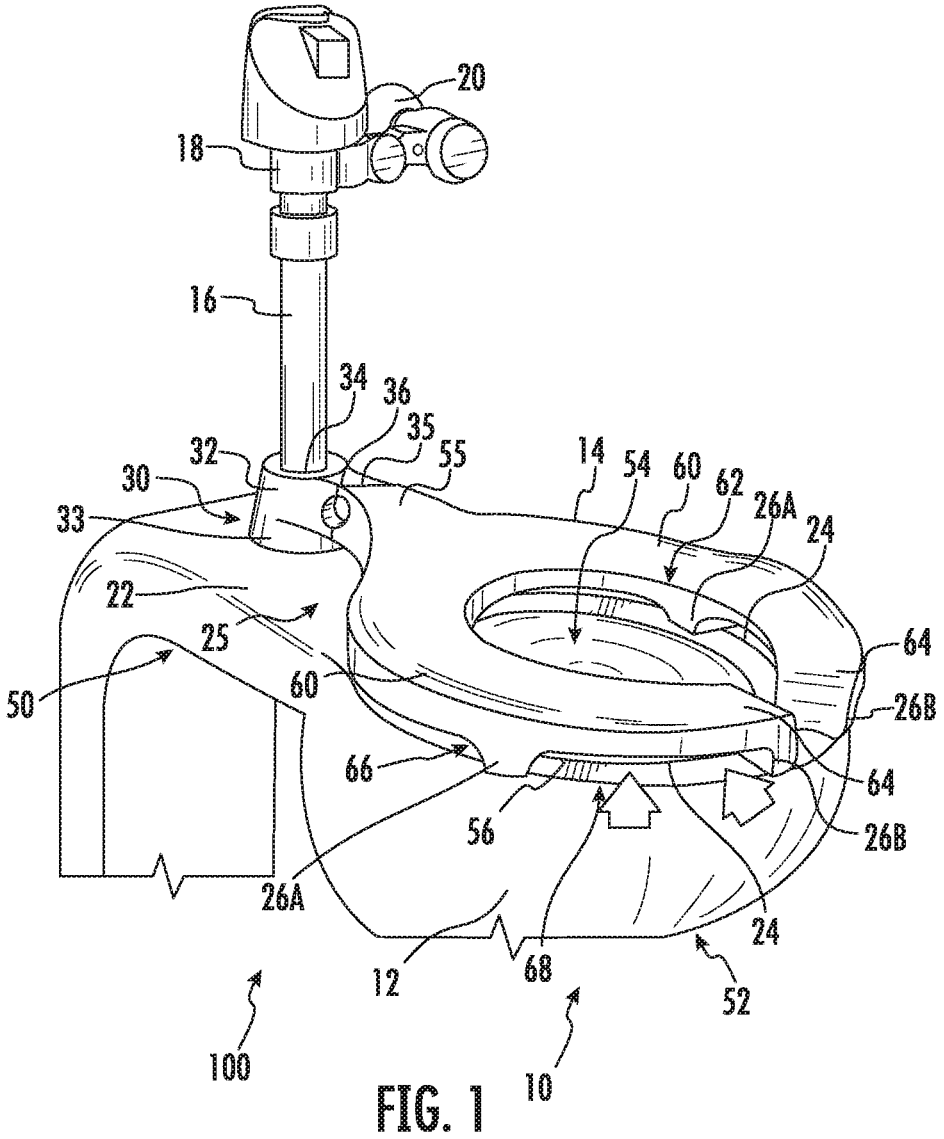
FIG. 1 is a perspective view of one embodiment of a toilet assembly according to aspects of the present disclosure, with a toilet seat of the toilet assembly in a lowered position.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Figure 2:
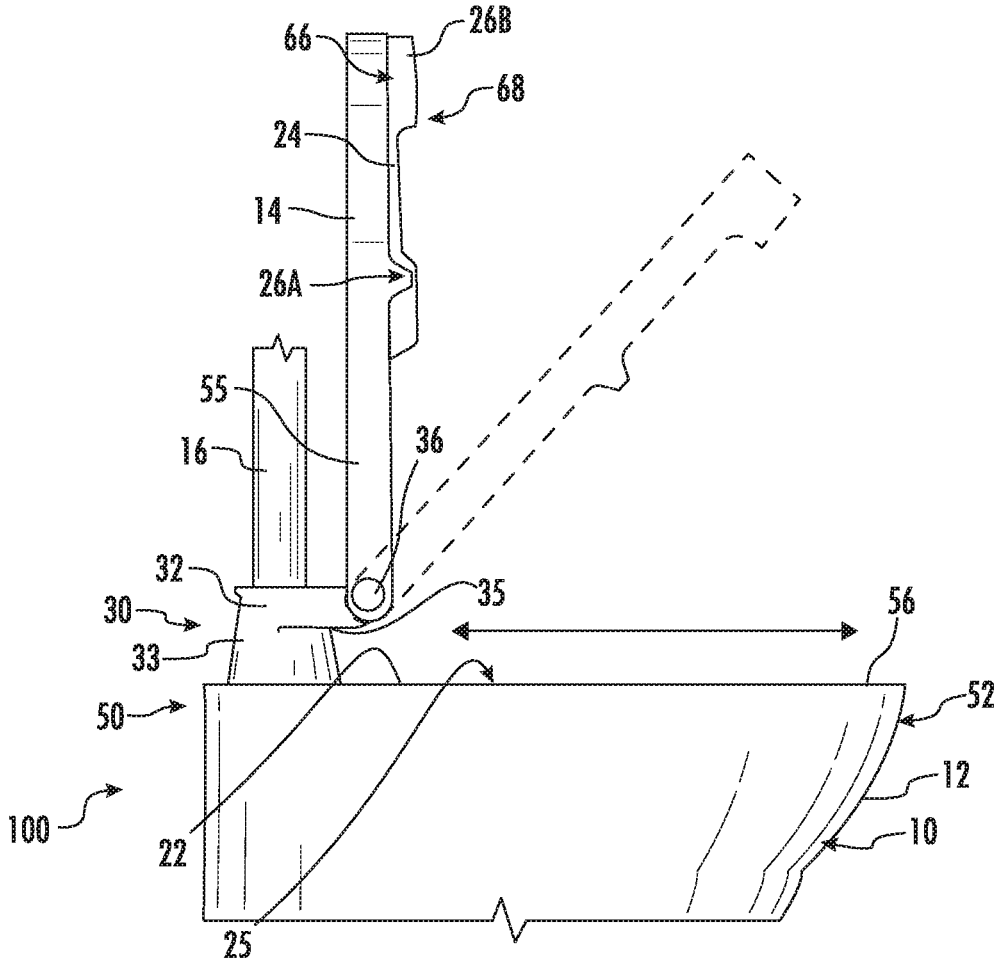
FIG. 2 is a side view of a portion of the toilet assembly of FIG. 1, with the toilet seat in a raised position.
Figure 3:
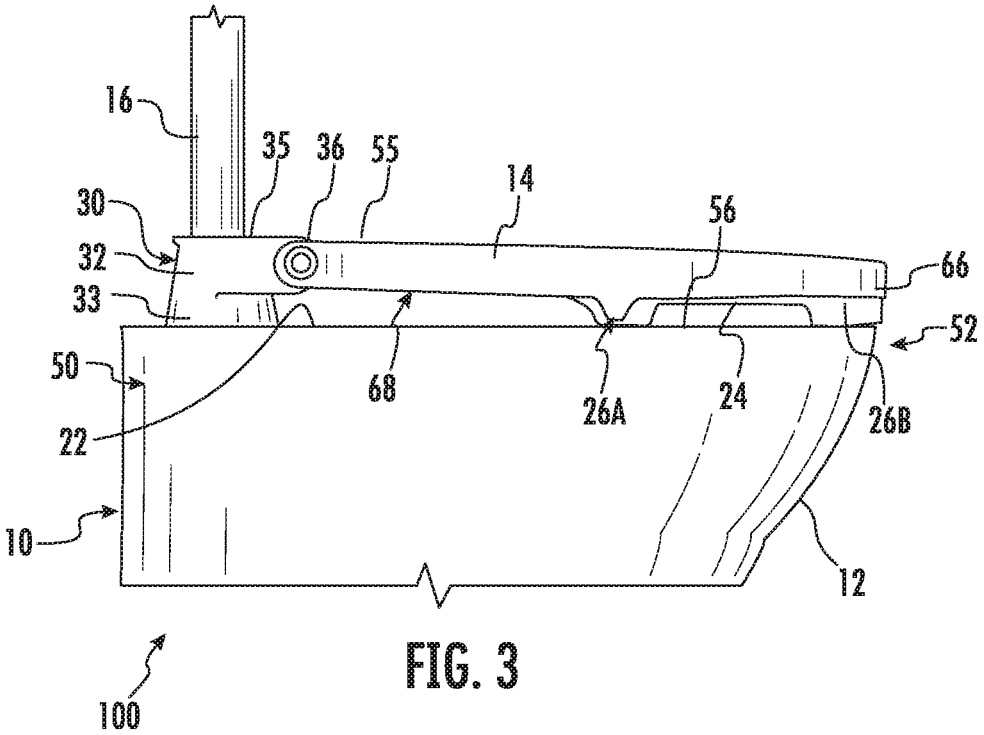
FIG. 3 is a side view of a portion of the toilet assembly of FIG. 1, with the toilet seat in the lowered position.

FIGS. 1-3 illustrate one embodiment of a toilet assembly 100 that includes a toilet 10 having a toilet body 12, a seat 14, and a water inlet pipe 16 that is connected to a flush valve 18 and a water supply 20. The toilet 10 in this embodiment is configured to be fixed to a wall surface (not shown) at a rear 50 of the toilet body 12 to extend from the wall to a front 52 of the toilet body 12 in a cantilevered manner, but may additionally or alternately be supported by and/or fixed to a floor surface (not shown) in another embodiment. The toilet body 12 includes a bowl 54 proximate the front 52 that is supplied with water from the water inlet pipe 16, as well as a rim 56 surrounding and/or extending around the bowl 54. The rear 50 of the toilet body 12 has a top surface 22 that is generally flat and contiguous with the rim 56, which is also generally flat, and the water inlet pipe 16 extends into the toilet body 12 by extending downward through a hole in the top surface 22. It is understood that the toilet body 12 may have internal structures and conduits for supplying water from the water inlet pipe 16 to the bowl 54 and draining the contents from the bowl 54 when flushed. The flush valve 18 controls the flow of water to the bowl 54 through the water inlet pipe 16.

The toilet seat 14 in FIGS. 1-3 includes two side portions 60, also referred to as first and second side portions 60, with an opening 62 defined between the side portions 60, such that the side portions 60 extend around opposite sides of the opening 62, and the opening 62 is configured to be positioned above the bowl 54 of the toilet 10. In the toilet seat 14 of FIGS. 1-3, the side portions 60 are joined at the rear of the seat 14 and have distal ends 64 that are spaced from each other at the front of the seat 14, forming a horseshoe-like structure. In other embodiments, the seat 14 may form a circular or oval structure. The seat 14 has a resting portion 66 configured to rest on the rim 56 of the toilet 10 when the seat 14 is lowered. The resting portion 66 in FIGS. 1-3 includes seat pads 26 that extend downward from the underside 68 of the seat 14 to rest on the rim 56. The seat pads 26 in this embodiment include first and second (or rear) seat pads 26A that are each positioned on one of the side portions 60 and third and fourth (or front) seat pads 26B that are positioned at the distal ends 64 of the side portions 60. The third and fourth seat pads 26B in FIGS. 1-3 are formed by the distal ends 64 of the side portions 60 curving or otherwise extending downward. The underside 68 of the seat 14 is raised between the front seat pads 26B and the rear seat pads 26A to form slots 24 that facilitate leverage by a user's hand or foot to raise the seat 14 by providing increased room for passage of the hand/foot beneath the seat 14.

The toilet seat 14 is mounted or connected to the water inlet pipe 16 in the embodiment of FIGS. 1-3 by an attachment 30, such that the seat 14 and the attachment 30 form a toilet seat assembly configured for connection to a toilet 10. The attachment 30 includes a coupling 32 with a passage 34 that receives the inlet pipe 16 therethrough and a hinge connection 36 connected to the coupling 32 and pivotably connected to the seat 14 to permit moving of the seat 14 by pivoting between a raised position (FIG. 2) and a lowered position (FIGS. 1 and 3). The attachment 30 also includes an arm 35 extending forward from the coupling 32 to the hinge connection 36, and the seat 14 in FIGS. 1-3 includes a narrow extension 55 that extends rearwardly from the seat 14 to meet the hinge connection 36. The coupling 32 engages the inlet pipe 16 in this embodiment, and may fixedly engage the inlet pipe 16 to resist movement of the attachment 30 with respect to the inlet pipe 16. The coupling 32 also extends completely around the inlet pipe 16 and is formed of a solid construction, such that installation or removal of the coupling 32 requires disconnection of the inlet pipe 16 from the toilet 10 and/or the flush valve 18. In other embodiments, this connection may be different. For example, the coupling 32 may not extend completely around the inlet pipe and/or may have a mechanical structure for opening and closing access to the passage 34 through the side of the coupling 32. The attachment 30 and the toilet seat 14 in FIGS. 1-3 have a single hinge connection 36 rather than two laterally spaced hinge connections as in existing toilet assemblies.

The attachment 30 in FIGS. 1-3 mounts to the base of the inlet pipe 16, and the attachment 30 further includes a base 33 connected to the coupling 32 and extending below the coupling 32 and rests on the top surface 22 of the toilet body 12. The passage 34 extends through both the base 33 and the coupling 32 in the attachment 30 of FIGS. 1-3, and the base 33 may be configured as one or more supporting legs that do not extend completely around the passage 34 in another embodiment. In this configuration, the base 33 spaces the coupling 32 and the hinge connection 36 upwardly above the top surface 22 of the toilet 10. This configuration facilitates cleaning of the rim 56 of the toilet 10 and beneath the seat 14. The attachment 30 may have various engaging features to fix the attachment 30 in position on the pipe 16 and resist movement of the attachment 30, including one or more friction-increasing features or structures within the passage 34, such as high-friction materials and/or surface textures/configurations, and/or mechanical fixing structures such as clamps, tension screws/bolts, or other such structures.

Figure 4:
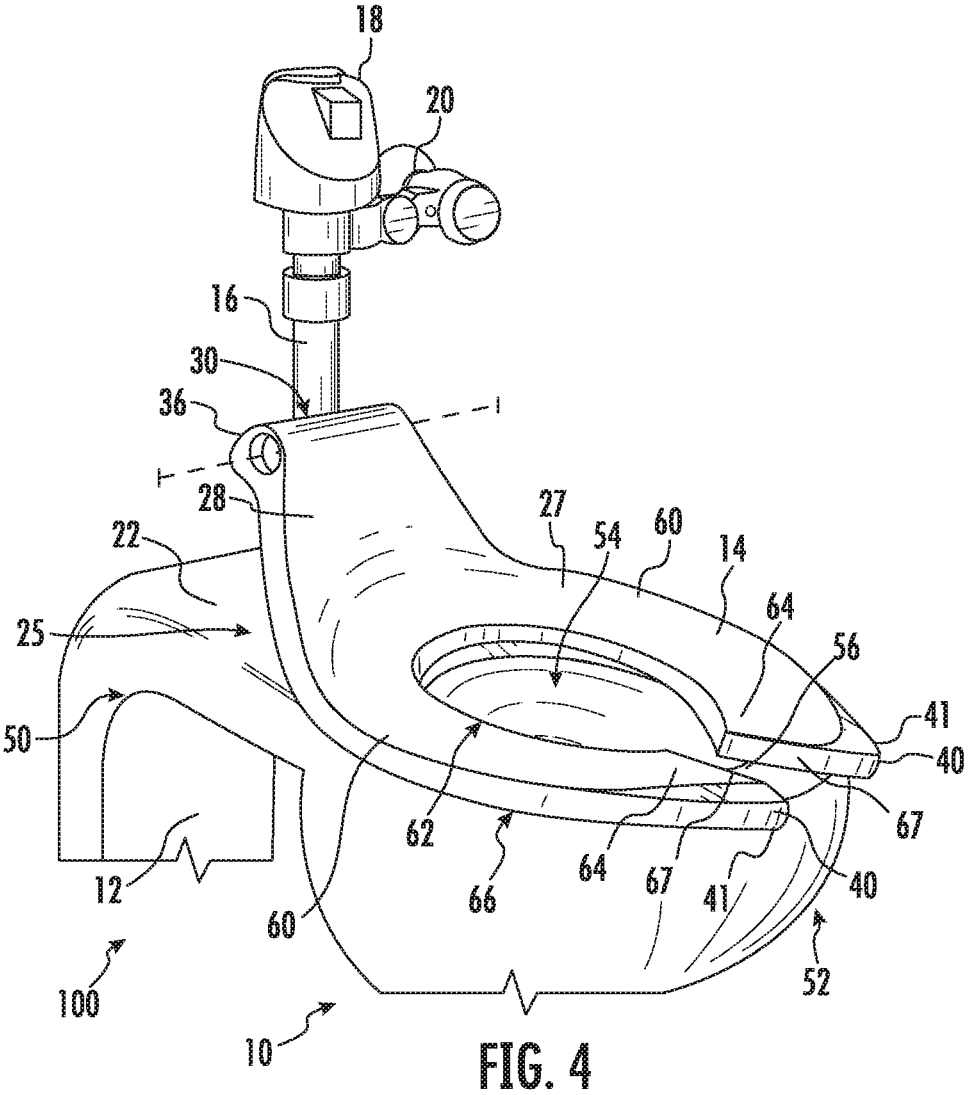
FIG. 4 is a perspective view of another embodiment of a toilet assembly according to aspects of the present disclosure, with a toilet seat of the toilet assembly in a lowered position.
Figure 5:
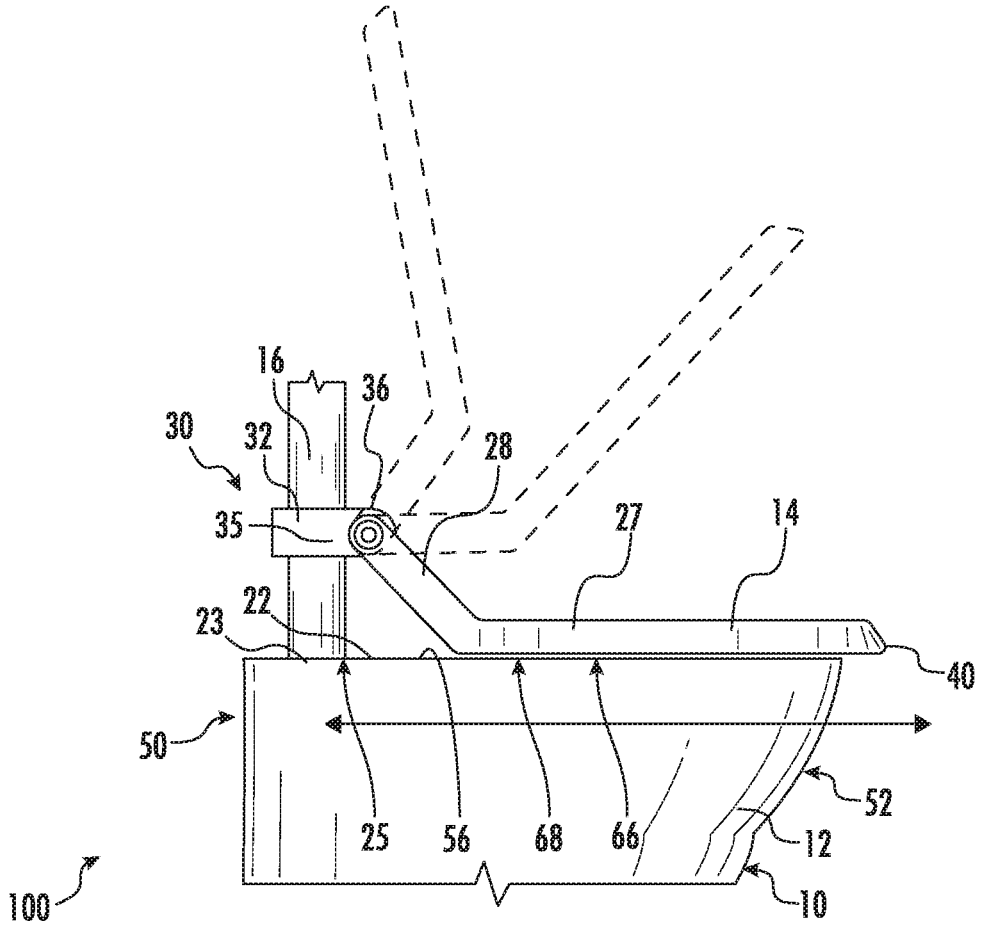
FIG. 5 is a side view of a portion of the toilet assembly of FIG. 4, with the toilet seat in the lowered position and schematically shown being pivoted to a raised position.
Figure 6:
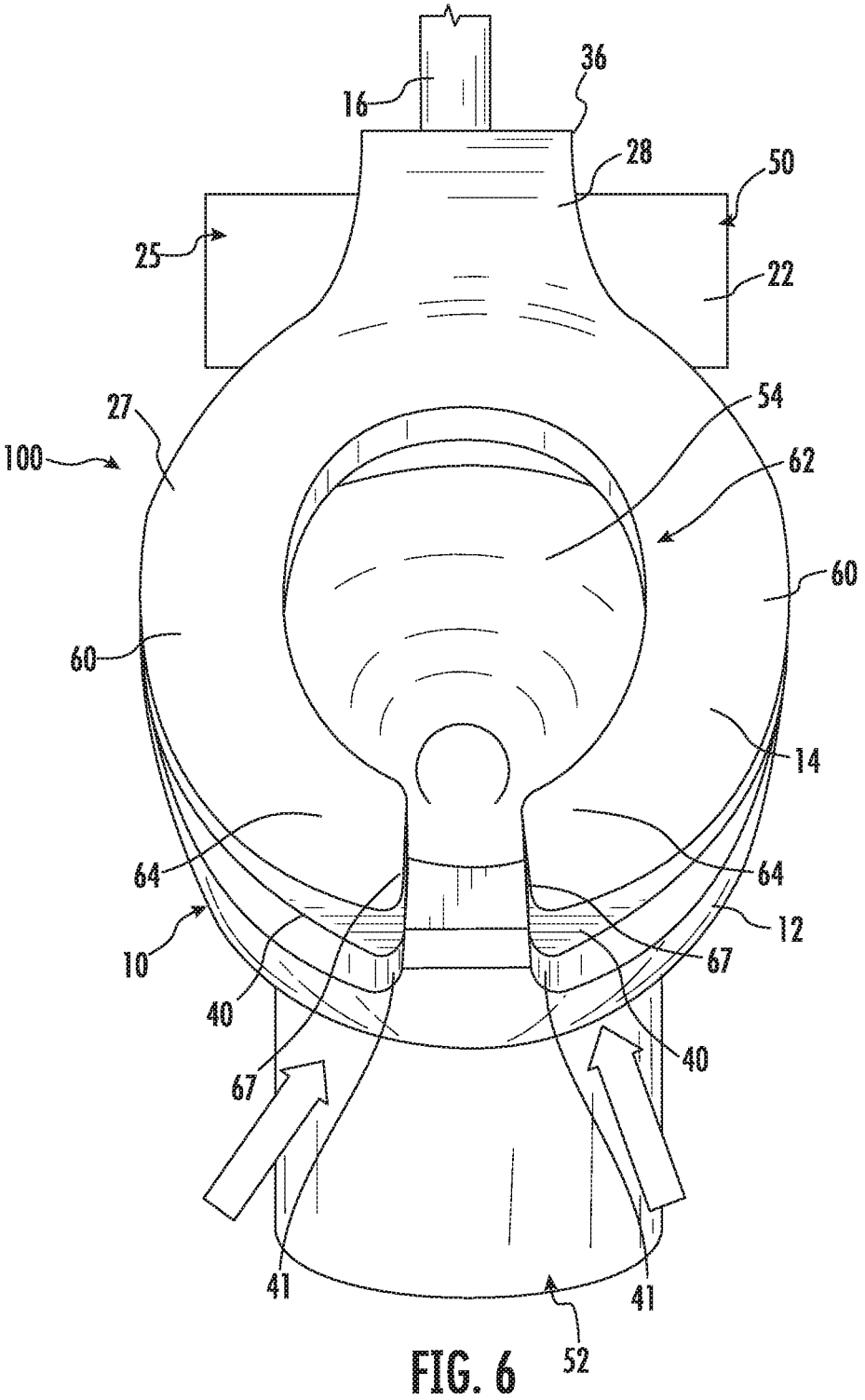
FIG. 6 is a top-front elevation view of the toilet assembly of FIG. 4, with the toilet seat in the lowered position.

FIGS. 4-6 illustrate another embodiment of a toilet assembly 100 that includes a toilet 10 with a seat 14 and attachment 30 that are different from the embodiment of FIGS. 1-3. The toilet body 12 in FIGS. 4-6 is similar to the toilet body 12 in FIGS. 1-3 and will not be re-described in detail for the sake of brevity. The toilet seat 14 and the attachment 30 in FIGS. 4-6 includes some structures and features in common with the seat 14 in FIGS. 1-3, and such similar structures and features may not be described again in detail herein. It is understood that the structures in FIGS. 4-6 that are described elsewhere herein with respect to other embodiments may include any features, variations, or alternate embodiments described herein. The seat 14 in FIGS. 4-6 includes two side portions 60 that extend around opposite sides of the opening 62 and are joined at the rear of the seat 14 and have distal ends 64 that are spaced from each other at the front of the seat 14, as similarly described herein. The seat 14 in FIGS. 4-6 also has lift handles 40 that extend beyond the front of the toilet body 12 to facilitate lifting of the seat 14 by the user's hand or foot. The lift handles 40 in FIGS. 4-6 are extensions of the body of the toilet seat 14 that have points 41 extending beyond the periphery of the toilet body 12 to facilitate placement of a user's hand/foot beneath the handles 40. The points 41 of the handles 40, at which the periphery of each handle 40 extends furthest from the periphery of the seat 14, are positioned at the distal ends 64 of the side portions 60. As shown in FIGS. 4 and 6, the distal ends 64 of the side portions 60 and the inner surfaces of the handles 40 form a smooth and continuous surface 67 at the front of the toilet 10 within the space between the side portions 60, and this continuous surface extends from the opening 62 to the points 41 of the handles 40. The lift handles 40 are fixed in this embodiment, but the lift handles 40 may be extendible and retractable by the user in another embodiment, as described herein. The seat 14 in FIGS. 4-6 further has a resting portion 66 on the underside 68 of the seat 14 configured to rest on the rim 56 of the toilet 10 when the seat 14 is lowered, which may include seat pads (not shown) or other structures. In the embodiment of FIGS. 4-6, the seat 14 has a generally flat lower portion 27 that includes the resting portion 66 and a raised rear portion 28 that extends upwardly from the lower portion 27. As shown in FIGS. 4-6, the raised rear portion 28 curves upwardly and rearwardly from the lower portion 27, but may have a more angular configuration in another embodiment. This curved configuration may provide improved ergonomics.

The attachment 30 in FIGS. 4-6 is connected to the pipe 16 at a location spaced above the top surface 22 of the toilet body 12, which eliminates surface mounting and further increases the ease of cleaning the top surface 22 of the toilet 10 and beneath the seat 14. The coupling 32 in FIGS. 4-6 has a passage 34 that receives the inlet pipe 16 therethrough and a hinge connection 36 connected to the coupling 32 and pivotably connected to the seat 14 to permit moving of the seat 14 by pivoting between a raised position and a lowered position (see FIG. 5). The coupling 32 fixedly engages the inlet pipe 16 in this embodiment to resist movement of the attachment 30 with respect to the inlet pipe 16 and may include structures such as friction-increasing structures and/or mechanical fixing structures to more securely engage the inlet pipe 16 as described herein. In this configuration, the lowermost point of the attachment 30 is spaced upwardly above the top surface 22 of the toilet 10. The raised rear portion 28 of the seat extends upwardly above the top surface 22 to meet the hinge 36, thereby spacing the hinge 36 upwardly above the top surface 22 of the toilet 10. The attachment 30 in FIGS. 4-6 is shown in further detail in FIGS. 11-12 and includes an arm 35 extending forward from the coupling 32 to the hinge connection 36. The assembly 10 in FIGS. 4-6 may include any additional features discussed herein with respect to FIGS. 1-3 or any other embodiments. It is understood that the handles 40 in FIGS. 4-6 may be incorporated into other embodiments described herein.

Figure 7:
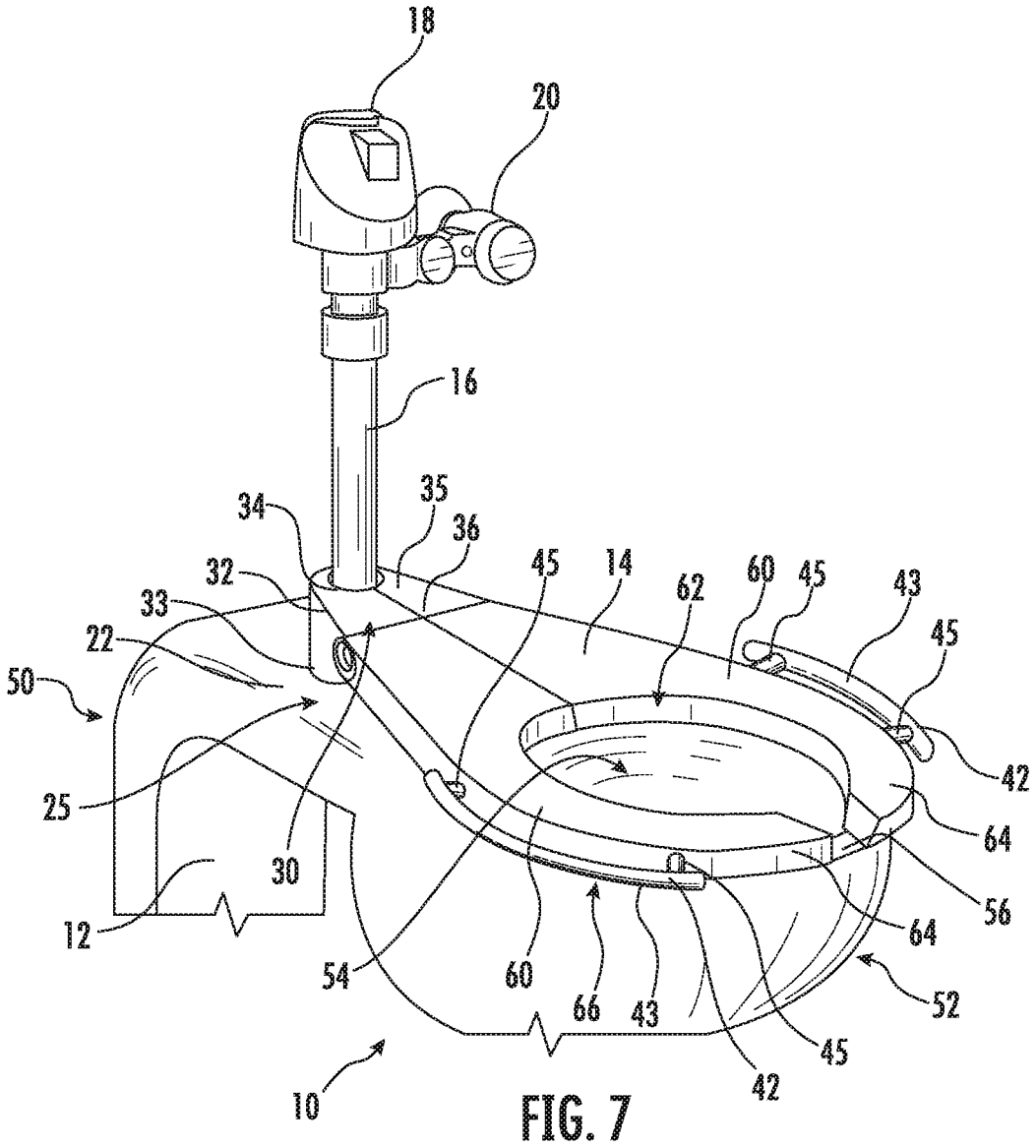
FIG. 7 is a perspective view of another embodiment of a toilet assembly according to aspects of the present disclosure, with a toilet seat of the toilet assembly in a lowered position.
Figure 8:
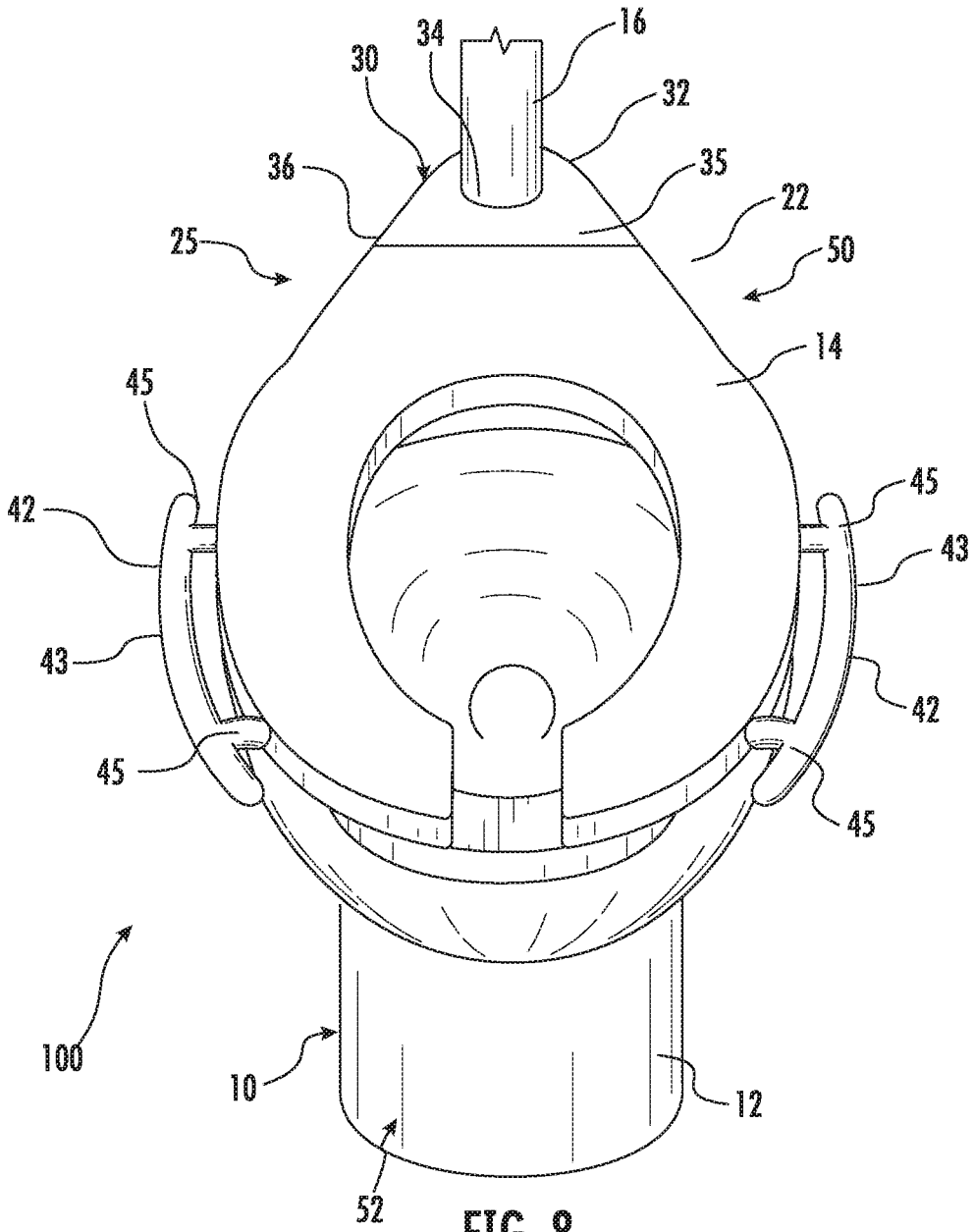
FIG. 8 is a top-front elevation view of the toilet assembly of FIG. 7, with the toilet seat in the lowered position.

FIGS. 7-8 illustrate another embodiment of a toilet assembly 100 that includes a toilet 10 with a seat 14 that is different from the embodiment of FIGS. 1-3. The toilet body 12 in FIGS. 7-8 is similar to the toilet body 12 in FIGS. 1-3 and will not be re-described in detail for the sake of brevity. The attachment 30 in FIGS. 7-8 is also similar to the attachment 30 in FIGS. 1-3, although the arm 35 of the attachment 30 in FIGS. 7-8 has a width that increases toward the hinge connection 36, such that the hinge connection 36 in FIGS. 7-8 is wider than the hinge connection 36 in FIGS. 1-3. Other features of the attachment 30 of FIGS. 7-8 will not be re-described in detail for the sake of brevity. It is understood that the structures in FIGS. 7-8 that are described elsewhere herein with respect to other embodiments may include any features, variations, or alternate embodiments described herein. The seat 14 in FIGS. 7-8 includes two side portions 60 that extend around opposite sides of the opening 62 and are joined at the rear of the seat 14 and have distal ends 64 that are spaced from each other at the front of the seat 14, as similarly described herein. The seat 14 in FIGS. 7-8 further has a resting portion 66 on the underside 68 of the seat 14 configured to rest on the rim 56 of the toilet 10 when the seat 14 is lowered, which may include seat pads (not shown) or other structures. Additionally, the seat 14 in FIGS. 7-8 has fixed side handles 42 that extend outward beyond the periphery of the toilet body 12 to facilitate lifting of the seat 14 by the user's hand or foot. The side handles 42 in FIGS. 7-8 each include a curved beam 43 that is curved similarly to the adjacent portions of the seat 14 and is spaced outwardly from the seat 14, with spaced posts 45 that connect the beam 43 to the seat 14. In this configuration, a user's hand or foot can pass beneath the handle 42 and/or between the handle 42 and the seat 14 to facilitate lifting. The assembly 10 in this embodiment may include any additional features discussed herein with respect to FIGS. 1-6 or any other embodiments. It is understood that the handles 42 in FIGS. 7-8 may be incorporated into other embodiments described herein.

Figure 9:
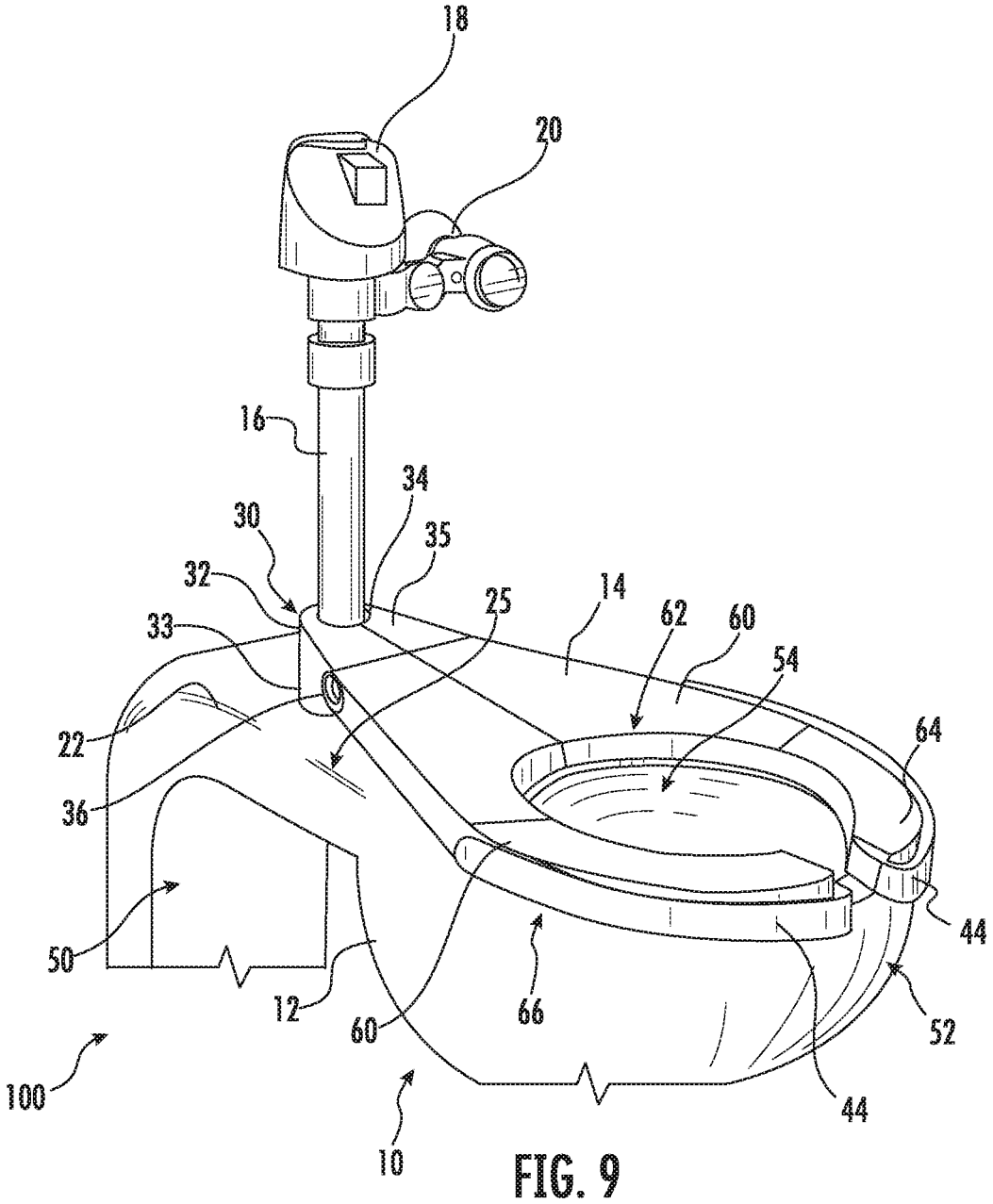
FIG. 9 is a perspective view of another embodiment of a toilet assembly according to aspects of the present disclosure, with a toilet seat of the toilet assembly in a lowered position.
Figure 10A:
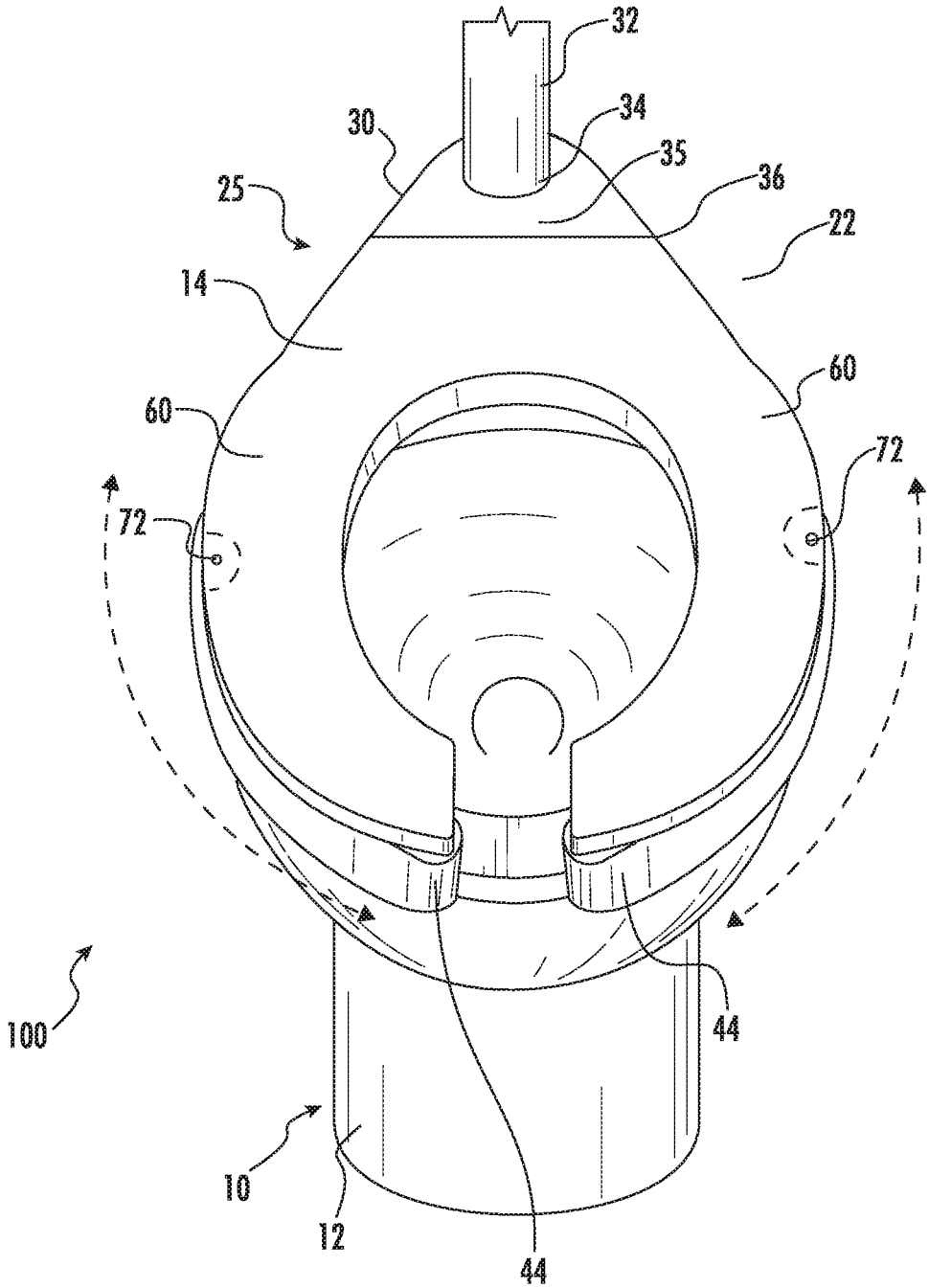
FIG. 10A is a top-front elevation view one configuration of the toilet assembly of FIG. 9, with the toilet seat in the lowered position, showing movement of extendible handles between retracted and extended positions.
Figure 10B:
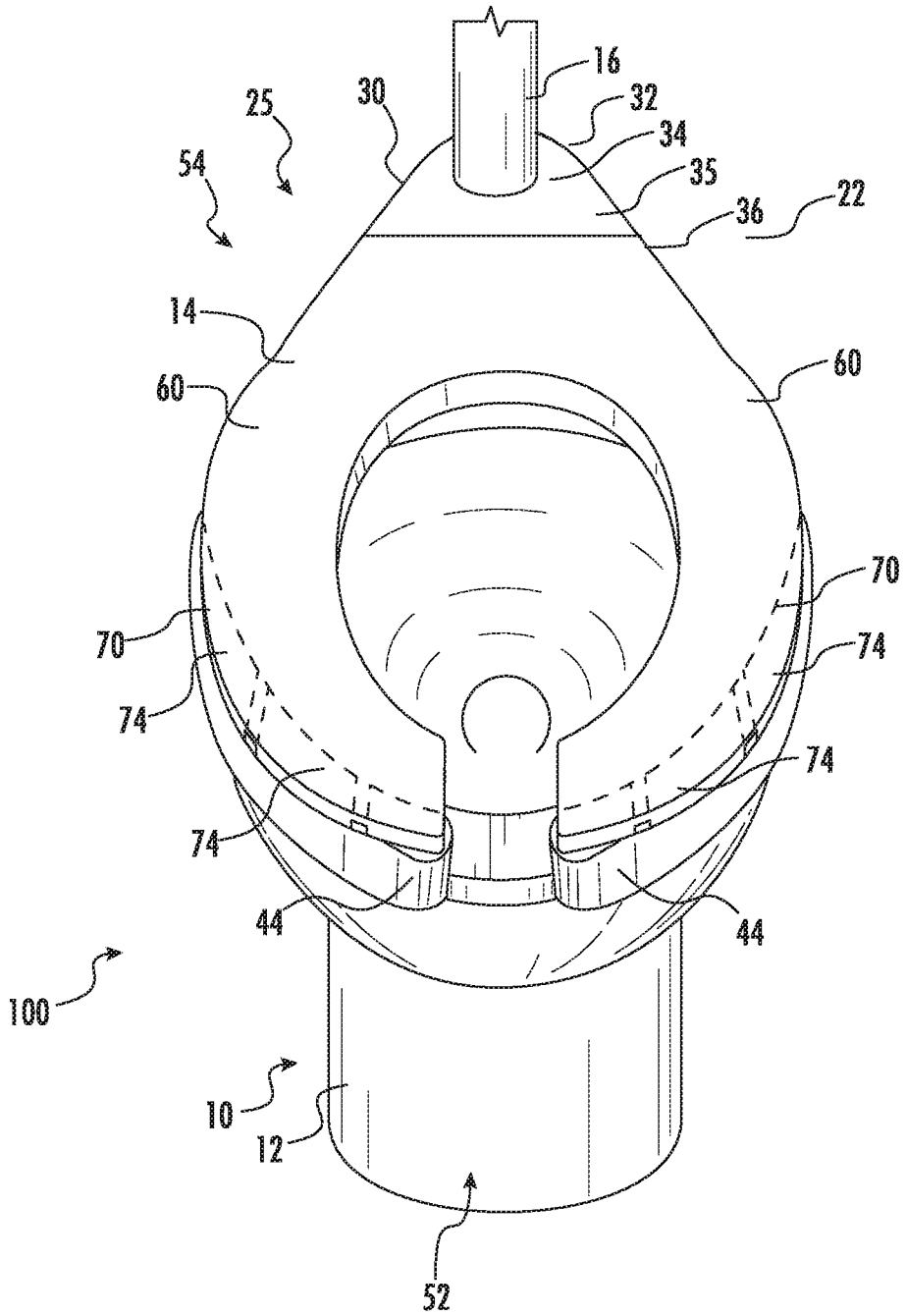
FIG. 10B is a top-front elevation view another configuration of the toilet assembly of FIG. 9, with the toilet seat in the lowered position, showing movement of extendible handles between retracted and extended positions.

FIGS. 9-10B illustrate another embodiment of a toilet assembly 100 that includes a toilet 10 with a seat 14 that is different from the embodiment of FIGS. 1-3. The toilet body 12 in FIGS. 9-10B is similar to the toilet body 12 in FIGS. 1-3 and will not be re-described in detail for the sake of brevity. The attachment 30 in FIGS. 9-10B is similar to the attachment 30 in FIGS. 7-8 and will not be re-described in detail for the sake of brevity. It is understood that the structures in FIGS. 9-10B that are described elsewhere herein with respect to other embodiments may include any features, variations, or alternate embodiments described herein. The seat 14 in FIGS. 9-10B includes two side portions 60 that extend around opposite sides of the opening 62 and are joined at the rear of the seat 14 and have distal ends 64 that are spaced from each other at the front of the seat 14, as similarly described herein. The seat 14 in FIGS. 9-10B further has a resting portion 66 on the underside 68 of the seat 14 configured to rest on the rim 56 of the toilet 10 when the seat 14 is lowered, which may include seat pads (not shown) or other structures. The seat 14 in the embodiment of FIGS. 9-10B has movable and retractable handles 44 that can be moved to extend beyond the front of the toilet body 12 to facilitate lifting of the seat 14 by the user's hand or foot, or retracted to avoid obstructing user leg position during sitting usage, as desired. In other words, the handles 44 may be movable between a retracted position, where the outer periphery of the handle 44 is positioned more proximate to the body of the seat 14, and an extended position, where the periphery of the handle 44 is positioned more distal from the body of the seat 14, and the handle 44 is extended to facilitate manipulation by the user as described herein.

FIG. 10A illustrates a first configuration, where the handles 44 are pivotably connected to the seat 14 at pivoting connections 72 (shown schematically) on the underside 68 of each side portion 60 of the seat 14 or within the body of the seat 14. In this configuration, the handles 44 can pivot outward as shown in FIG. 10A to extend the handles 44 further outward from the seat 14 and to retract the handles 44. The handles 44 in FIG. 10A may further include springs or other biasing means for biasing the handles 44 toward the retracted position, such that the handles 44 retract when not acted on by a user.

FIG. 10B illustrates a second configuration, where the handles 44 have a portion received within a cavity 70 (shown schematically) on the underside 68 of each side portion 60 of the toilet seat 14 and are movable by sliding further into the cavity 70 or out of the cavity 70 to move between the extended and retracted positions. The handles 44 and the seat 14 in FIG. 10B have guiding structure for this movement, such as one or more interlocking tab and slot arrangements 74 (shown schematically), as well as stop structures to limit motion and define the range of motion. The handles 44 in FIG. 10B may further include springs or other biasing means for biasing the handles 44 toward the retracted position, such that the handles 44 retract when not acted on by a user. The cavity 70 may alternately be defined within the interior of the seat 14 instead of as a recess on the underside 68 of the seat 14. In other embodiments, the handles 44 may be configured for a different type of motion, and the seat 14 may have mounting and guiding structures configured for such motion. The assembly 10 in this embodiment may include any additional features discussed herein with respect to FIGS. 1-8 or any other embodiments. It is understood that the handles 44 in FIGS. 9-10B may be incorporated into other embodiments described herein. It is also understood that the embodiment of FIGS. 9-10B may be provided with fixed handles, such as the handles 40, 42 in FIGS. 4-8.

Figure 11:
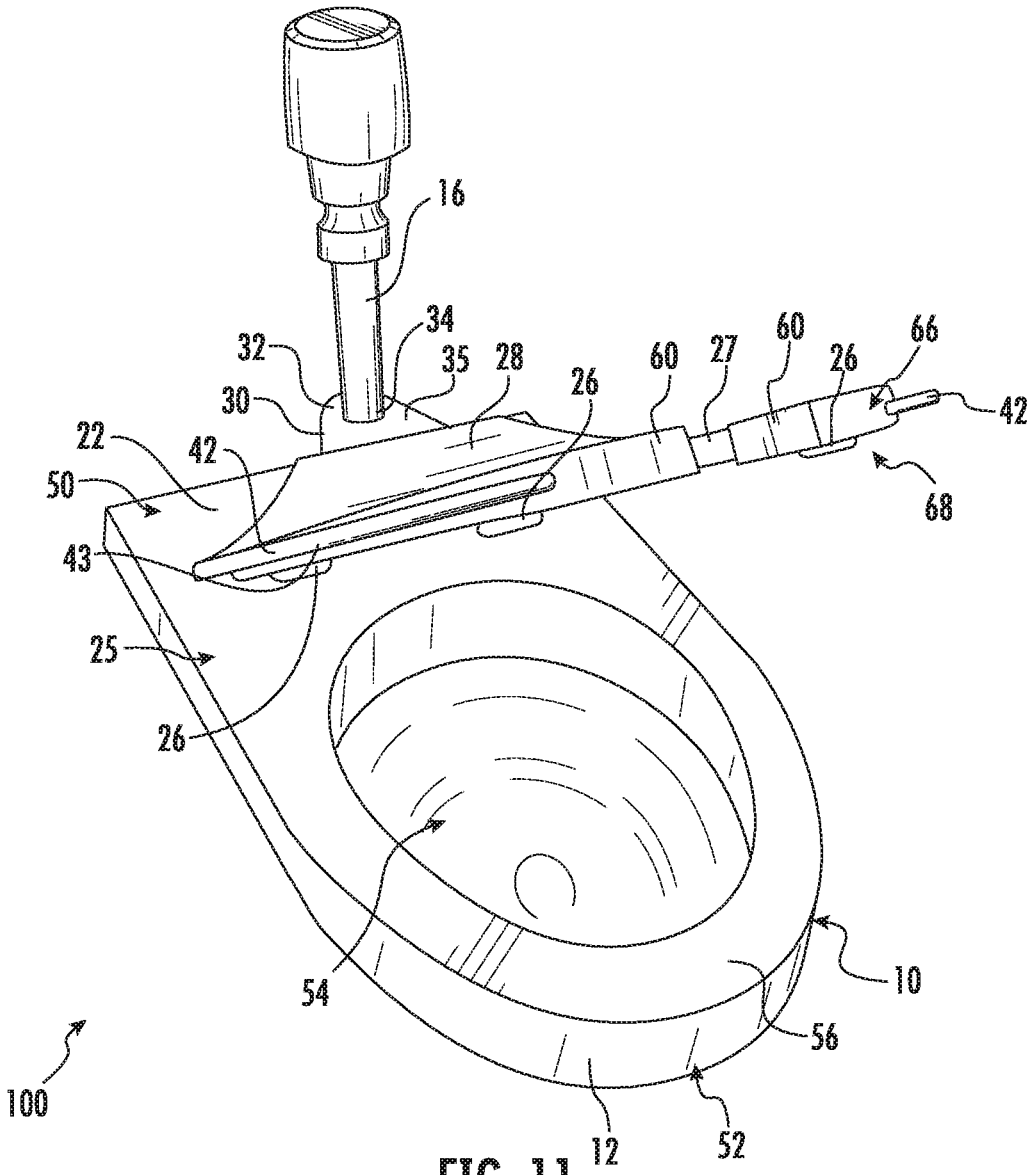
FIG. 11 is a perspective view of another embodiment of a toilet assembly according to aspects of the present disclosure, with a toilet seat of the toilet assembly in a raised position.
Figure 12:
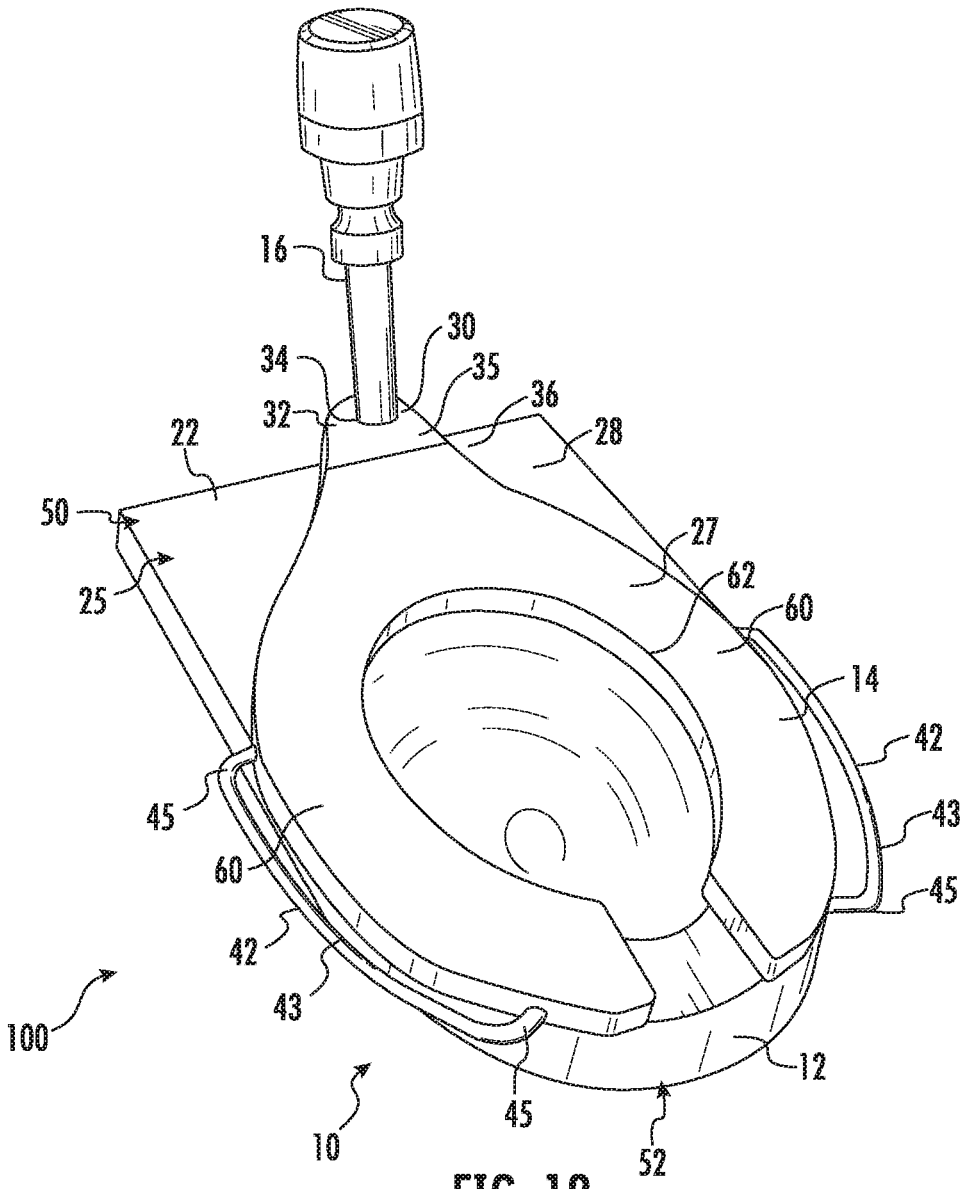
FIG. 12 is a perspective view of the toilet assembly of FIG. 11, with the toilet seat in a lowered position.

FIGS. 11-12 illustrate another embodiment of a portion of a toilet assembly 100 that includes a toilet 10 with a seat 14 that is different from the embodiment of FIGS. 1-3. The toilet body 12 in FIGS. 11-12, when shown in its entirety, may be the same or similar to the toilet body 12 in FIGS. 1-3 and will not be re-described in detail for the sake of brevity. The toilet assembly 100 in FIGS. 11-12 incorporates an attachment 30 and seat 14 that are similar to the attachment 30 and seat 14 in FIGS. 4-6, with side handles 42 that are similar to the side handles 42 in FIGS. 7-8. These structures will therefore not be re-described in detail for the sake of brevity. It is understood that the structures in FIGS. 11-12 that are described elsewhere herein with respect to other embodiments may include any features, variations, or alternate embodiments described herein. The seat 14 in FIGS. 11-12 includes two side portions 60 that extend around opposite sides of the opening 62 and are joined at the rear of the seat 14 and have distal ends 64 that are spaced from each other at the front of the seat 14, as similarly described herein.

The seat 14 in FIGS. 11-12 further has a resting portion 66 on the underside 68 of the seat 14 configured to rest on the rim 56 of the toilet 10 when the seat 14 is lowered, which may include seat pads 26 or other structures. As similarly described with respect to FIGS. 4-6, the coupling 32 of the attachment 30 in FIGS. 11-12 is fixedly engaged with the inlet pipe 16 at a location spaced upwardly above the top surface 22 of the toilet, so that the hinge connection 36 is also spaced above the top surface 22. In this configuration, the seat 14 has a generally flat lower portion 27 that includes the resting portion 66 and a raised rear portion 28 that extends upwardly from the lower portion 27 to connect to the hinge connection 36. The posts 45 of the side handles 42 in FIGS. 11-12 connect to the lower portion 27 of the seat 14. The assembly 10 in this embodiment may include any additional features discussed herein with respect to FIGS. 1-10 or any other embodiments.

The toilet assemblies 100 in the embodiments shown in FIGS. 1-12 and described herein all include a single hinge connection 36 located proximate a front-to-rear centerline of the toilet 10, rather than two laterally spaced hinge connections on opposite sides of the centerline as in existing toilet assemblies. The hinge connections 36 in FIGS. 1-12 are thicker, stronger, and more robust in construction compared to existing hinge connections that are typically used in toilets. In addition to the sanitary benefits as described herein, the single-point hinge connections 36 provide the advantage of simplified installation and adjustment as compared to existing toilets with multiple hinge connections.

The toilet assemblies 100 in the embodiments shown in FIGS. 1-12 and described herein also require no holes, cavities, connections, etc. to be made on the toilet body 12 for mounting of the lid 14, because the lid 14 is not connected to the toilet body 12 in any of these embodiments. In these configurations, the only hole or other opening in the top surface 22 of the toilet 10 is the hole 23 that receives the water inlet pipe 16, and the toilet body 12 may be configured to have no other openings between the rearmost point of the top surface 22 to the rim 56. This hole 23 is indicated in FIG. 5, but is not visible in the other figures. In the embodiments of FIGS. 1-12, the top surface 22 of each toilet 10 has an uninterrupted, smooth, flat, horizontal surface 25 that surrounds the hole 23 receiving the water inlet pipe 16 and extends at least from the hole 23 to the rim 56. Additionally, this uninterrupted surface 25 may be continuous and coplanar with the rim 56 of the toilet 10, such that the uninterrupted surface 25 and the rim 56 of the toilet 10 form a single, planar surface. The uninterrupted surface 25 may also extend the entire lateral width of the top surface 22 of the toilet 10 and/or extend to, or proximate to, the rearmost point at the rear 50 of the toilet 10. As used herein, the term "uninterrupted" means that the surface has no holes, openings, cavities, physical attachments, or other disruptions from a smooth surface contour. In one embodiment, the uninterrupted surface 25 may have no holes or openings that extend through the outer wall of the toilet body 12 other than the hole 23 for the inlet pipe 16. It is understood that the uninterrupted surface 25 may not be flat in other embodiments, and may have some angular or curved contours while remaining smooth and uninterrupted. This uninterrupted surface 25 improves sanitation of the toilet 10, as there are no holes, crevices, or other spaces where bacteria or unsanitary material can penetrate.

The toilet assemblies 100, toilet seats 14, and attachments 30 in the embodiments shown and described herein provide increased ease of cleaning and disinfecting compared to existing toilet seat attachments, which use holes in the toilet body 12 that can accumulate dirt and microbes that can be difficult or impossible to clean and eliminate. Configurations that raise the structure of the hinge connection 36 above the top surface 22 of the toilet 10 also facilitate access to portions of the top surface 22 of the toilet 10 and portions of the seat 14 that may be difficult to access in existing toilets and toilet assemblies. In addition to actual sanitation benefits, the use of these configurations also provide the visual appearance of greater cleanliness. The attachments 30 also provide quick and simple installation. The configurations of the seats 14 shown and described herein may also provide increased ergonomics. Further, the various configurations of handles 40, 42, 44 and slots 24 described herein assist users in lifting the seat in an easier and more sanitary manner. Other benefits and advantages are recognized by one skilled in the art as well.

Various embodiments of toilet assemblies 10 and components thereof have been described herein, which include various components and features. In other embodiments, the assembly 10 may be provided with any combination of such components and features. It is also understood that in other embodiments, the various devices, components, and features of the toilet assemblies 10 described herein may be constructed with similar structural and functional elements having different configurations, including different ornamental appearances.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "side," "rear," "proximal," "distal," and the like, as used herein, are intended for illustrative purposes only and do not limit the embodiments in any way. When used in description of a method or process, the term "providing" (or variations thereof) as used herein means generally making an article available for further actions, and does not imply that the entity "providing" the article manufactured, assembled, or otherwise produced the article. Nothing in this specification should be construed as requiring a specific three dimensional orientation of structures in order to fall within the scope of this invention, unless explicitly specified by the claims. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A toilet assembly comprising:

a toilet comprising a toilet body having a bowl at a front of the toilet, with a rim surrounding the bowl, and a vertical water inlet pipe extending upward from a rear of the toilet, behind the bowl, wherein the vertical water inlet pipe is configured to be connected to a water supply to supply water to the bowl;

a toilet seat having a resting portion configured to rest on the rim and having an opening positioned above the bowl; and an attachment connected to the water inlet pipe and the toilet seat, the attachment comprising a coupling having a vertical passage that receives the water inlet pipe therethrough, such that the coupling engages the vertical water inlet pipe, and a hinge connection connected to the coupling, wherein the toilet seat is pivotably connected to the hinge connection of the attachment to pivotably mount the toilet seat on the toilet, such that the toilet seat is pivotable about the hinge connection between a raised position, where the resting portion of the toilet seat is raised above the rim of the toilet, and a lowered position, where the resting portion of the toilet seat rests on the rim of the toilet.

2. The toilet assembly of claim 1, wherein the toilet seat comprises a first side portion extending around a first side of the opening and a second side portion extending around a second side of the opening opposite the first side, and wherein the resting portion comprises a first seat pad on an underside of the toilet seat on the first side portion, and a second seat pad on the underside of the toilet seat on the second side portion, the first and second seat pads configured to rest on the rim of the toilet.

3. The toilet assembly of claim 2, wherein the first and second side portions are joined at a rear of the toilet seat and distal ends of the first and second side portions are spaced from each other at a front of the toilet seat, and wherein the first seat pad extends downward from the underside of the toilet seat on the first side portion, and the second seat pad extends downward from the underside of the toilet seat on the second side portion, the resting portion further comprising:

a third seat pad on the first side portion configured to rest on the rim of the toilet, wherein the distal end of the first side portion curves downward to form the third seat pad, and wherein the underside of the toilet seat on the first side portion is raised to form a first slot between the first and third seat pads; and a fourth seat pad on the second side portion configured to rest on the rim of the toilet, wherein the distal end of the second side portion curves downward to form the fourth seat pad, wherein the underside of the toilet seat on the second side portion is raised to form a second slot between the second and fourth seat pads.

4. The toilet assembly of claim 1, wherein the vertical water inlet pipe extends through a top surface of the rear of the toilet, and wherein the coupling is positioned such that the hinge connection is positioned at a location spaced upward from the top surface of the rear of the toilet, wherein the attachment further comprises a base connected to the coupling and extending below the coupling to rest on the top surface of the rear of the toilet to space the coupling and the hinge connection above the top surface.

5. A toilet assembly comprising:

a toilet comprising a toilet body having a bowl at a front of the toilet, with a rim surrounding the bowl, and a water inlet pipe extending upward from a rear of the toilet, behind the bowl, wherein the water inlet pipe is configured to be connected to a water supply to supply water to the bowl;

a toilet seat having a resting portion configured to rest on the rim and having an opening positioned above the bowl; and an attachment connected to the water inlet pipe and the toilet seat, the attachment comprising a coupling having a passage that receives the water inlet pine therethrough, such that the coupling engages the water inlet pipe, and a hinge connection connected to the coupling, wherein the toilet seat is pivotably connected to the hinge connection of the attachment to pivotably mount the toilet seat on the toilet, such that the toilet seat is pivotable about the hinge connection between a raised position, where the resting portion of the toilet seat is raised above the rim of the toilet, and a lowered position, where the resting portion of the toilet seat rests on the rim of the toilet, wherein the water inlet pipe extends through a top surface of the rear of the toilet, and wherein the coupling is positioned such that the hinge connection is positioned at a location spaced upward from the top surface of the rear of the toilet, wherein the coupling fixedly engages the water inlet pipe such that a lowermost point of the attachment is spaced upward from the top surface of the rear of the toilet.

6. A toilet assembly comprising:

a toilet comprising a toilet body having a bowl at a front of the toilet, with a rim surrounding the bowl, and a water inlet pipe extending upward from a rear of the toilet, behind the bowl, wherein the water inlet pipe is configured to be connected to a water supply to supply water to the bowl;

a toilet seat having a resting portion configured to rest on the rim and having an opening positioned above the bowl, and an attachment connected to the water inlet pipe and the toilet seat, the attachment comprising a coupling having a passage that receives the water inlet pipe therethrough, such that the coupling engages the water inlet pipe, and a hinge connection connected to the coupling, wherein the toilet seat is pivotably connected to the hinge connection of the attachment to pivotably mount the toilet seat on the toilet, such that the toilet seat is pivotable about the hinge connection between a raised position, where the resting portion of the toilet seat is raised above the rim of the toilet, and a lowered position, where the resting portion of the toilet seat rests on the rim of the toilet, wherein a top surface of the toilet body has a hole receiving the water inlet pipe and has an uninterrupted surface that surrounds the hole and extends from the hole to the rim across an entire width of the top surface.

7. A toilet seat assembly comprising:

a toilet seat having an opening configured to be positioned above a bowl of a toilet and comprising a first side portion extending around a first side of the opening, a second side portion extending around a second side of the opening opposite the first side, a first seat pad on an underside of the toilet seat on the first side portion, and a second seat pad on the underside of the toilet seat on the second side portion, wherein the first and second seat pads are configured to rest on a rim of the toilet; and an attachment connected to the toilet seat and configured to be connected to a vertical water inlet pipe extending upward from a rear of the toilet, the attachment comprising a coupling having a vertical passage that is configured to receive the vertical water inlet pipe therethrough, such that the coupling is configured to engage the vertical water inlet pipe, and a hinge connection connected to the coupling, wherein the toilet seat is pivotably connected to the hinge connection of the attachment, such that the attachment is configured for pivotably mounting the toilet seat on the toilet, and wherein the toilet seat is pivotable about the hinge connection between a raised position, where the first and second seat pads of the toilet seat are configured to be raised above the rim of the toilet, and a lowered position, where the first and second seat pads of the toilet seat are configured to rest on the rim of the toilet.

8. The toilet seat assembly of claim 7, wherein the first side portion and the second side portion are joined at a rear of the toilet seat and are spaced at a front of the toilet seat, and wherein the first seat pad extends downward from the underside of the toilet seat on the first side portion, and the second seat pad extends downward from the underside of the toilet seat on the second side portion, the toilet seat further comprising:

a third seat pad on the first side portion configured to rest on the rim of the toilet, wherein a distal end of the first side portion curves downward to form the third seat pad, and wherein the underside of the toilet seat on the first side portion is raised to form a first slot between the first and third seat pads; and a fourth seat pad on the second side portion configured to rest on the rim of the toilet, wherein a distal end of the second side portion curves downward to form the fourth seat pad, wherein the underside of the toilet seat on the second side portion is raised to form a second slot between the second and fourth seat pads.

9. The toilet seat assembly of claim 7, wherein the coupling is positioned such that the hinge connection is positioned at a location spaced upward from a top surface of a rear of the toilet, wherein the attachment further comprises a base connected to the coupling and extending below the coupling and configured to rest on the top surface of the rear of the toilet to space the coupling and the hinge connection above the top surface.

10. A toilet seat assembly comprising:

a toilet seat having an opening configured to be positioned above a bowl of a toilet and comprising a first side portion extending around a first side of the opening, a second side portion extending around a second side of the opening opposite the first side, a first seat pad on an underside of the toilet seat on the first side portion, and a second seat pad on the underside of the toilet seat on the second side portion, wherein the first and second seat pads are configured to rest on a rim of the toilet; and an attachment connected to the toilet seat and configured to be connected to a water inlet pipe of the toilet, the attachment comprising a coupling having a passage that is configured to receive the water inlet pipe therethrough, such that the coupling is configured to engage the water inlet pipe, and a hinge connection connected to the coupling, wherein the toilet seat is pivotably connected to the hinge connection of the attachment, such that the attachment is configured for pivotably mounting the toilet seat on the toilet, and wherein the toilet seat is pivotable about the hinge connection between a raised position, where the first and second seat pads of the toilet seat are configured to be raised above the rim of the toilet, and a lowered position, where the first and second seat pads of the toilet seat are configured to rest on the rim of the toilet, wherein the coupling is positioned such that the hinge connection is positioned at a location spaced upward from a top surface of a rear of the toilet, wherein the coupling is configured to fixedly engage the water inlet pipe such that a lowermost point of the attachment is configured to be spaced upward from the top surface of the rear of the toilet.

11. A toilet assembly comprising:

a toilet comprising a toilet body having a bowl at a front of the toilet, with a rim surrounding the bowl, and a water inlet pipe extending upward from a top surface of a rear of the toilet, behind the bowl, wherein the water inlet pipe is configured to be connected to a water supply to supply water to the bowl;

a toilet seat having a resting portion configured to rest on the rim and having an opening positioned above the bowl; and an attachment connected to the water inlet pipe and the toilet seat, the attachment comprising a coupling fixedly engaging the water inlet pipe at a location spaced upward from the top surface of the rear of the toilet, such that a lowermost point of the attachment is spaced upward from the top surface of the rear of the toilet, and a hinge connection connected to the coupling, wherein the toilet seat is pivotably connected to the hinge connection of the attachment to pivotably mount the toilet seat on the toilet, such that the toilet seat is pivotable about the hinge connection between a raised position, where the resting portion of the toilet seat is raised above the rim of the toilet, and a lowered position, where the resting portion of the toilet seat rests on the rim of the toilet.

12. The toilet assembly of claim 11, wherein the toilet seat comprises a first side portion extending around a first side of the opening and a second side portion extending around a second side of the opening opposite the first side, and wherein the resting portion comprises a first seat pad on an underside of the toilet seat on the first side portion, and a second seat pad on the underside of the toilet seat on the second side portion, the first and second seat pads configured to rest on the rim of the toilet, wherein the first and second side portions are joined at a rear of the toilet seat and distal ends of the first and second side portions are spaced from each other at a front of the toilet seat, and wherein the first seat pad extends downward from the underside of the toilet seat on the first side portion, and the second seat pad extends downward from the underside of the toilet seat on the second side portion, the resting portion further comprising:

a third seat pad on the first side portion configured to rest on the rim of the toilet, wherein the distal end of the first side portion curves downward to form the third seat pad, and wherein the underside of the toilet seat on the first side portion is raised to form a first slot between the first and third seat pads; and a fourth seat pad on the second side portion configured to rest on the rim of the toilet, wherein the distal end of the second side portion curves downward to form the fourth seat pad, wherein the underside of the toilet seat on the second side portion is raised to form a second slot between the second and fourth seat pads.

13. The toilet assembly of claim 11, wherein the toilet seat has a lower portion having the resting portion thereon and a raised rear portion extending upwardly from the lower portion, and wherein the raised rear portion of the toilet seat is pivotably connected to the hinge connection of the attachment to pivotably mount the toilet seat on the toilet, such that the raised rear portion of the toilet seat extends upward from the lower portion of the toilet seat and upward above the top surface of the rear of the toilet to connect to the hinge connection.

14. The toilet assembly of claim 11, wherein the coupling has a friction-increasing structure engaging the water inlet pipe, such that the friction-increasing structure is configured to resist slippage between the water inlet pipe and the attachment for fixedly engaging the water inlet pipe.

15. The toilet assembly of claim 11, wherein a top surface of the toilet body has a hole receiving the water inlet pipe and has an uninterrupted surface that surrounds the hole and extends from the hole to the rim across an entire width of the top surface.

16. The toilet assembly of claim 11, wherein the coupling has a mechanical structure for fixedly engaging the water inlet pipe.

17. A toilet seat assembly comprising:

a toilet seat having an opening configured to be positioned above a bowl of a toilet, the toilet seat having a lower portion having a resting portion configured to rest on a rim of the toilet and a raised rear portion extending upwardly from the lower portion; and an attachment connected to the toilet seat and configured to be connected to a water inlet pipe of the toilet, the attachment comprising a coupling configured to fixedly engage the water inlet pipe at a location spaced upward from a top surface of a rear of the toilet, such that a lowermost point of the attachment is configured to be spaced upward from the top surface of the rear of the toilet, and a hinge connection connected to the coupling, wherein the raised rear portion of the toilet seat is pivotably connected to the hinge connection of the attachment such that the attachment is configured for pivotably mounting the toilet seat on the toilet, and such that the raised rear portion of the toilet seat extends upward from the lower portion of the toilet seat and is configured to extend upward above the top surface of the rear of the toilet to connect to the hinge connection, and wherein the toilet seat is pivotable about the hinge connection between a raised position, where the resting portion of the toilet seat is configured to be raised above the rim of the toilet, and a lowered position, where the resting portion of the toilet seat is configured to rest on the rim of the toilet.

18. The toilet seat assembly of claim 17, wherein the toilet seat comprises a first side portion extending around a first side of the opening and a second side portion extending around a second side of the opening opposite the first side, and wherein the resting portion comprises a first seat pad on an underside of the toilet seat on the first side portion, and a second seat pad on the underside of the toilet seat on the second side portion, the first and second seat pads configured to rest on the rim of the toilet, wherein the first and second side portions are joined at a rear of the toilet seat and distal ends of the first and second side portions are spaced from each other at a front of the toilet seat, and wherein the first seat pad extends downward from the underside of the toilet seat on the first side portion, and the second seat pad extends downward from the underside of the toilet seat on the second side portion, the resting portion further comprising:

a third seat pad on the first side portion configured to rest on the rim of the toilet, wherein the distal end of the first side portion curves downward to form the third seat pad, and wherein the underside of the toilet seat on the first side portion is raised to form a first slot between the first and third seat pads; and a fourth seat pad on the second side portion configured to rest on the rim of the toilet, wherein the distal end of the second side portion curves downward to form the fourth seat pad, wherein the underside of the toilet seat on the second side portion is raised to form a second slot between the second and fourth seat pads.

19. The toilet seat assembly of claim 17, wherein the coupling has a friction-increasing structure configured for engaging the water inlet pipe, such that the friction-increasing structure is configured to resist slippage between the water inlet pipe and the attachment for fixedly engaging the water inlet pipe.

20. The toilet seat assembly of claim 17, wherein the coupling has a mechanical structure configured for fixedly engaging the water inlet pipe.

* * * * *